US007208017B2

(12) United States Patent
Yamakita et al.

(10) Patent No.: US 7,208,017 B2
(45) Date of Patent: Apr. 24, 2007

(54) PROCESSING AGENTS AND METHODS FOR SYNTHETIC FIBERS

(75) Inventors: Hiroshi Yamakita, Gamagori (JP); Satoshi Aratani, Gamagori (JP)

(73) Assignee: Takemoto Yushi Kabushiki Kaisha, Aichi (JP)

( * ) Notice: Subject to any disclaimer, the term of this patent is extended or adjusted under 35 U.S.C. 154(b) by 14 days.

(21) Appl. No.: 11/139,081

(22) Filed: May 26, 2005

(65) Prior Publication Data

US 2005/0268403 A1 Dec. 8, 2005

(30) Foreign Application Priority Data

Jun. 3, 2004 (JP) ..... 2004-165233

(51) Int. Cl.
*D06M 11/00* (2006.01)

(52) U.S. Cl. ..... 8/115.6; 8/115.51; 8/115.54; 8/115.62; 252/8.9; 252/8.81

(58) Field of Classification Search ..... 8/115.6, 8/115.51, 115.54, 115.62; 252/8.81, 8.9
See application file for complete search history.

(56) References Cited

U.S. PATENT DOCUMENTS

| | | | | |
|---|---|---|---|---|
| 4,561,987 | A * | 12/1985 | Yamamoto et al. | 252/8.84 |
| 5,061,384 | A * | 10/1991 | Suzuki et al. | 252/8.84 |
| 6,143,038 | A * | 11/2000 | Yamamoto et al. | 8/115.6 |
| 6,200,492 | B1 * | 3/2001 | Eicken et al. | 252/8.81 |
| 6,730,130 | B2 * | 5/2004 | Sakuraba et al. | 8/115.51 |
| 2002/0161123 | A1 * | 10/2002 | Li et al. | 525/178 |

* cited by examiner

*Primary Examiner*—Lorna M. Douyon
*Assistant Examiner*—Tri Nguyen
(74) *Attorney, Agent, or Firm*—Beyer Weaver LLP

(57) ABSTRACT

A processing agent for synthetic fibers contains four specified kinds of components (Components A, B, C and D) each by a specified amount and also by a specified total amount so as to have improved characteristics of preventing occurrence of fluffs yard breaking and uneven dyeing when applied to synthetic fibers at a specified rate.

9 Claims, No Drawings

PROCESSING AGENTS AND METHODS FOR SYNTHETIC FIBERS

Priority is claimed on Japanese Patent Application 2004-165233 filed Jun. 3, 2004.

BACKGROUND OF THE INVENTION

This invention relates to agents for the processing of synthetic fibers and methods of processing synthetic fibers.

With the recent increase in the speed of spinning and fabrication processes for synthetic fibers, occurrence of fluffs and breaking in produced yarns, as well as uneven dyeing of the fabric is becoming even more frequent. In order to prevent such occurrence of fluffs, yarn breaking and uneven dyeing, it has been known to increase the content of a functional improvement agent serving as a processing agent for the synthetic fibers to be applied thereto or to increase the amount of such a processing agent to be applied but such prior art attempts have not be sufficient in view of the recent increase in the speed. It is therefore an object of this invention to provide improved processing agents and methods for synthetic fibers capable of sufficiently preventing the occurrence of fluffs, yarn breaking and uneven dyeing.

It has been known to use processing agents containing a lubricant and a functional improvement agent for synthetic fibers. Known examples of processing agents containing a functional improvement agent for preventing the occurrence of fluffs, yarn breaking and uneven dyeing include those described in Japanese Patent Publications Tokkai 1-298281, 2-47372, 60-181368, 2000-136448, 60-9971, 1-306684, 2-269878 and 62-85076 and U.S. Pat. Nos. 6,432,144B1 and 5,472,623A. These processing agents are not sufficiently capable of preventing the occurrence of fluffs, yarn breaking and uneven dyeing in view of the requirement of the recent years due to increased processing speed.

SUMMARY OF THE INVENTION

The present invention is based on the discovery by the present inventors, as a result of their studies for providing processing agents and methods for synthetic fibers capable of sufficiently preventing the occurrence of fluffs, yarn breaking and uneven dyeing, that use should be made of an agent containing four specified components at specified ratios and that a specified amount of an aqueous solution of such an agent should be applied to the synthetic fibers.

DETAILED DESCRIPTION OF THE INVENTION

The invention firstly relates to a processing agent for synthetic fibers characterized as containing Component A, Component B, Component C and Component D as defined below in a total amount of 70 weight % of more, containing 55–92 weight parts of Component A, 0.3–5 weight parts of Component B, 0.1–3 weight parts of Component C and 0.6–44 weight parts of Component D for 100 weight parts of the total of Components A, B, C and D, where Component A is one or more selected from alkyleneoxide addition compounds simultaneously satisfying Conditions 1, 2 and 3 wherein Condition 1 is the condition of having a number average molecular weight of 1000–12000 and being obtainable by adding alkylene oxide with 2–4 carbon atoms to monohydric-trihydric aliphatic alcohol with 1–24 carbon atoms, Condition 2 is the condition of having polyoxyalkylene groups comprising oxyalkylene units of which 10–80 weight % are oxyethylene units, and Condition 3 is the condition of containing 30 weight % or more of alkyleneoxide addition compounds obtained by adding ethylene oxide and propylene oxide to monohydric aliphatic alcohol with 6–24 carbon atoms at weight ratio of 35/65–80/20; Component B is polyoxyalkylene-modified silicone having polyoxyalkylene groups comprising oxyalkylene units which are oxyethylene units and/or oxypropylene units and containing the polyoxyalkylene groups and silicone chains at weight ratio of 25/75–90/10; Component C is one or more selected from phenol antioxidants, phosphite antioxidants and thioether antioxidants; and Component D is one or more selected from emulsifiers, antistatic agents and lubricant coadjuvants.

The invention secondly relates to a method of processing synthetic fibers characterized as applying a processing agent for synthetic fibers according to this invention to synthetic fibers at a rate of 0.1–3 weight % with respect to the synthetic fibers.

The processing agent for synthetic fibers according to this invention (hereinafter referred to simply as the processing agent of this invention) will be explained next more in detail. As explained summarily above, the processing agent of this invention is characterized as containing four specified kinds of components (Components A–D) and Component A is one or more selected from alkyleneoxide addition compounds which simultaneously satisfy three specified conditions (Conditions 1–3).

Condition 1 on Component A is a requirement that the alkyleneoxide addition compounds, which Component A is, should have a number average molecular weight of 1000–12000 and be obtainable by adding alkylene oxide with 2–4 carbon atoms to monohydric-trihydric aliphatic alcohol with 1–24 carbon atoms. Examples of such monohydric-trihydric aliphatic alcohol with 1–24 carbon atoms include (1) monohydric straight-chain saturated aliphatic alcohols such as methyl alcohol, ethyl alcohol, propyl alcohol, butyl alcohol, pentyl alcohol, hexyl alcohol, heptyl alcohol, octyl alcohol, nonyl alcohol, decyl alcohol, undecyl alcohol, dodecyl alcohol, tridecyl alcohol, tetradecyl alcohol, pentadecyl alcohol, hexadecyl alcohol, heptadecyl alcohol, octadecyl alcohol, nonadecyl alcohol, eicosyl alcohol, heneicosyl alcohol, docosyl alcohol, tricosyl alcohol and tetracosyl alcohol; (2) monohydric branched-chain saturated aliphatic alcohols such as isopropyl alcohol, isobutyl alcohol, isopentyl alcohol, 2-methyl-pentyl alcohol, 2-ethyl-hexyl alcohol, 2-propyl-heptyl alcohol, 2-butyl-octyl alcohol, 2-pentyl-nonyl alcohol, 2-hexyl-decyl alcohol, 2-heptyl-undecyl alcohol, 2-octyl-dodecyl alcohol, 2-nonyl-tridecyl alcohol, 2-decyl-tridecyl alcohol, 2-undecyl-pentadecyl alcohol and 2-dodecyl-hexadecyl alcohol; (3) monohydric straight-chain unsaturated aliphatic alcohols such as 10-undecenyl alcohol, 9c-tetradecenyl alcohol, 9c-hexadecenyl alcohol, 9c-octadecenyl alcohol, 9t-octadecenyl alcohol, 9c,12c-octadecadienyl alcohol, 9c,12c,15c-octadecatrienyl alcohol, 9c-eicosenyl alcohol, 5,8,11,14-eicosatetraenyl alcohol, 13c-docosenyl alcohol and 13t-docosenyl alcohol; (4) dihydric aliphatic alcohols such as ethylene glycol, 1,2-propane diol, 1,3-propane diol, 1,4-butane diol, 1,6-hexane diol and neopentyl glycol; and (5) trihydric aliphatic alcohols such as glycerol and trimethylol propane.

Examples of alkylene oxide with 2–4 carbon atoms in Condition 1 include ethylene oxide, propylene oxide, 1,2-butylene oxide and 1,4-butylene oxide but ethylene oxide and propylene oxide are preferred. These alkylene oxides may be used singly or as a mixture. If they are used as a mixture, the form of addition of alkylene oxides to monohydric-trihydric aliphatic alcohol with 1–24 carbon atoms may be random addition, block addition or random-block addition.

The number average molecular weight of alkyleneoxide addition compounds satisfying Condition 1 as described above is in the range of 1000–12000, and preferably 1000–10000.

Condition 2 on Component A is a requirement that the alkyleneoxide addition compounds should have polyoxyalkylene groups comprising oxyalkylene units of which 10–80 weight % are oxyethylene units.

Condition 3 on Component A is a requirement of containing 30 weight % or more of alkyleneoxide addition compounds obtained by adding ethylene oxide and propylene oxide to monohydric aliphatic alcohol with 6–24 carbon atoms at weight ratio of 35/65–80/20. Examples of such monohydric aliphatic alcohol with 6–24 carbon atoms include (1) monohydric straight-chain saturated aliphatic alcohols such as hexyl alcohol, heptyl alcohol, octyl alcohol, nonyl alcohol, decyl alcohol, undecyl alcohol, dodecyl alcohol, tridecyl alcohol, tetradecyl alcohol, pentadecyl alcohol, hexadecyl alcohol, heptadecyl alcohol, octadecyl alcohol, nonadecyl alcohol, eicosyl alcohol, heneicosyl alcohol, docosyl alcohol, tricosyl alcohol and tetracosyl alcohol; (2) monohydric branched-chain saturated aliphatic alcohols such as 2-methyl-pentyl alcohol, 2-ethyl-hexyl alcohol, 2-propyl-heptyl alcohol, 2-butyl-octyl alcohol, 2-pentyl-nonyl alcohol, 2-hexyl-decyl alcohol, 2-heptyl-undecyl alcohol, 2-octyl-dodecyl alcohol, 2-nonyl-tridecyl alcohol, 2-decyl-tridecyl alcohol, 2-undecyl-pentadecyl alcohol and 2-dodecyl-hexadecyl alcohol; and (3) monohydric straight-chain unsaturated aliphatic alcohols such as 10-undecenyl alcohol, 9c-tetradecenyl alcohol, 9c-hexadecenyl alcohol, 9c-octadecenyl alcohol, 9t-octadecenyl alcohol, 9c,12c-octadecadienyl alcohol, 9c,12c,15c-octadecatrienyl alcohol, 9c-eicosenyl alcohol, 5,8,11,14-eicosatetraenyl alcohol, 13c-docosenyl alcohol and 13t-docosenyl alcohol.

Component A is one or more selected from alkyleneoxide addition compounds simultaneously satisfying aforementioned Conditions 1, 2 and 3 but those containing Component E and Component F described below by a total amount of 60 weight % or more at a weight ratio of 40/60–80/20 are preferred, where Component E is an alkyleneoxide addition compound with number average molecular weight of 1000–12000, obtained by adding ethylene oxide and propylene oxide to monohydric-trihydric aliphatic alcohol with 4–13 carbon atoms at a weight ratio of 35/65–80/20 and Component F is an alkyleneoxide addition compound with number average molecular weight of 1000–4000, obtained by adding ethylene oxide and propylene oxide to monohydric aliphatic alcohol with 14–16 carbon atoms at a weight ratio of 35/65–80/20.

Examples of monohydric-trihydric aliphatic alcohol with 4–13 carbon atoms for Component E include butyl alcohol, pentyl alcohol, hexyl alcohol, heptyl alcohol, octyl alcohol, nonyl alcohol, decyl alcohol, undecyl alcohol, dodecyl alcohol, tridecyl alcohol, 2-methyl-pentyl alcohol, 2-ethyl-hexyl alcohol, 2-propyl-heptyl alcohol, 2-butyl-octyl alcohol, 1,4-butane diol, 1,6-hexane diol, neopentyl glycol and trimethylol propane. Among these, however, monohydric aliphatic alcohols with 6–13 carbon atoms such as hexyl alcohol, heptyl alcohol, octyl alcohol, nonyl alcohol, decyl alcohol, undecyl alcohol, dodecyl alcohol and tridecyl alcohol are preferred.

Examples of monohydric aliphatic alcohol with 14–16 carbon atoms for Component F include tetradecyl alcohol, pentadecyl alcohol, hexadecyl alcohol, 2-pentyl-nonyl alcohol, 2-hexyl-decyl alcohol, 9c-tetradecenyl alcohol and 9c-hexadecenyl alcohol. Among these, however, those containing 70 molar % or more of straight-chain aliphatic alcohol such as tetradecyl alcohol, pentadecyl alcohol and hexadecyl alcohol are preferred.

These alkyleneoxide addition compounds serving as Component A themselves can be synthesized by a commonly known method such as the method of causing alkylene oxides with 2–4 carbon atoms to sequentially undergo addition reactions to aliphatic alcohol in the presence of an alkaline catalyst.

Component B is polyoxyalkylene-modified silicone having polyoxyalkylene groups comprising oxyalkylene units which are oxyethylene units and/or oxypropylene units and containing the polyoxyalkylene groups and silicone chains at weight ratio of 25/75–90/10. Examples of such polyoxyalkylene-modified silicone include (1) polyoxyethylene-modified silicone having a polyoxyethylene group with a repetition of oxyethylene units, (2) polyoxypropylene-modified silicone having a polyoxypropylene group with a repetition of oxypropylene units, and (3) polyoxyethylenepolyoxypropylene-modified silicone having a polyoxyethylenepolyoxypropylene group with a repetition of oxyethylene units and oxypropylene units. Among these, however, those having a polyoxyalkylene group of which more than 25 weight % of the total oxyalkylene units are oxyethylene units are particularly preferred. The weight ratio between the polyoxyalkylene group and the silicone chain in the polyoxyalkylene-modified silicone as Component B is 25/75–90/10, and is more preferably 30/70–85/15. There is no particular limitation on the number average molecular weight of the polyoxyalkylene-modified silicone but it is preferable to be in the range of 2500–50000.

The polyoxyalkylene-modified silicone of Composition B, as explained above, is of a structure with a polyalkylene group connected through a carbon atom which is directly connected to the silicon atom in the silicone chain. The polyoxyalkylene group may be connected to the silicone chain as a straight chain or as a side chain. Methods of synthesizing such examples of polyoxyalkylene-modified silicone themselves are known.

Component C is one or more selected from phenol antioxidants, phosphite antioxidants and thioether antioxidants.

Examples of phenol antioxidants serving as Component C include triethyleneglycol-bis[3-(3-t-butyl-5-methyl-4-hydroxyphenyl) propionate], 1,3,5-trimethyl-2,4,6-tris(3,5-di-t-butyl-4-hydroxybenzyl) benzene, 1,6-hexanediol-bis[3-(3,5-di-t-butyl-4-hydroxyphenyl) propionate], pentaerythritol-tetrakis[3-(3,5-di-t-butyl-4-hydroxyphenyl) propionate], 2,2'-methylene-bis-(6-t-butyl-4-methylphenol), 2,2'-butylidene-bis-(6-t-butyl-4-methylphenol), 1,1,3-tris(2-methyl-4-hydroxy-5-t-butylphenol) butane, 1,3,5-tris(3',5'-di-t-butyl-4-hydroxybenzyl) isocyanuric acid and 1,3,5-tris(4-butyl-3-hydroxy-2,6-dimethylbenzyl) isocyanuric acid.

Examples of phosphite antioxidant serving as Component C include octyldiphenyl phosphite, trisnonylphenyl phosphite, tetratridecyl-4,4'-butylidene-bis-(2-t-butyl-5-methylphenol) diphosphite, mono(dinonylphenyl) phosphite and di(p-nonylphenyl) phosphite.

Examples of thioether antioxidant serving as Component C include 4,4'-thiobis-(6-t-butyl-3-methylphenol) and dilauryl-3,3'-thiodipropionate.

Among the antioxidants mentioned above, phenol antioxidants are preferable as Component C.

Component D is one or more selected from emulsifiers, antistatic agents and lubricant coadjuvants.

Examples of emulsifier serving as Component D include nonionic surfactants, anionic surfactants, cationic surfactants and ampholytic surfactants. Among these, however, nonionic surfactants are preferred. Examples of such nonionic surfactant include (1) ether-type nonionic surfactants having polyoxyalkylene group in the molecule such as polyoxyalkylene alkylether, polyoxyalkylene alkylphenylether, polyoxyalkylene alkylester, alkylene oxide adducts of castor oil, polyoxyalkylene alkylaminoether and polyoxyalkylene alkylamideether; (2) partial esters of polyhydric alcohol type nonionic surfactant such as sorbitan monolaurate, sorbitan trioleate, glycerol monolaurate and diglycerol dilaurate; (3) polyoxyalkylene esters of polyhydric alcohol and aliphatic acid type nonionic surfactants such as alkylene oxide adducts of partial ester of trihydric-hexahydric alcohol and aliphatic acid, alkylene oxide adducts of partial or complete ester of trihydric-hexahydric alcohol and aliphatic acid and alkylene oxide adducts of ester of trihydric-hexahydric alcohol and hydroxy aliphatic acid; and (4) alkylamide type nonionic surfactants such as diethanolamine monolauroamide and diethylene triamine dioctylamide. Among these, however, ether type nonionic surfactants are preferred.

Examples of antistatic agent serving as Component D include anionic surfactants, cationic surfactants, ampholytic surfactants and nonionic surfactants. Among these, however, anionic surfactants are preferred. Examples of such anionic surfactants include organic sulfonic acid salts such as sodium dodecyl benzene sulfonate, organic sulfuric acid salts such as sodium ester of polyoxyethylene lauryl sulfuric acid, organic phosphoric acid ester salts such as potassium polyoxyethylenelauryl phosphate and organic aliphatic acid salts such as sodium oleate and potassium alkenyl succinate.

Examples of lubricant coadjuvant as Component D include (1) esters of aliphatic monohydric alcohol and aliphatic monocarboxylic acid such as butyl stearate, octyl stearate, oleyl laurate and oleyl oleate; esters of aliphatic polyhydric alcohol and aliphatic monocarboxylic acid such as 1,6-hexanediol didecanoate and trimethlolpropane monooleate monolaurate; aliphatic ester compounds of aliphatic monohydric alcohol and aliphatic polycarboxylic acid such as dilauryl adipate and dioleyl azelate; (2) esters of aromatic alcohol and aliphatic monocarboxylic acid such as bezyl stearate and benzyl laurate; aromatic ester compounds of aliphatic monohydric alcohol and aromatic carboxylic acid such as diisostearyl isophthalate and trioctyl trimellitate; and (3) mineral oils with viscosity $2\times10^{-3}$–$1.3\times10^{-1}$ $m^2/s$ at 30° C. and paraffin content equal to or greater than 60 weight %. Particularly preferable among the above are aliphatic ester compounds shown by $R^1$—X—$R^2$ (referred to as Formula (1)) and/or aliphatic ester compounds shown by $R^3$—$R^4$ (referred to as Formula (2)) where $R^1$ and $R^3$ are each residual group obtained by removing hydrogen atom from aliphatic monohydric alcohol with 8–18 carbon atoms, $R^2$ is residual group obtained by removing hydrogen atom from aliphatic monocarboxylic acid with 8–18 carbon atoms, $R^4$ is residual group obtained by removing hydoxyl group from aliphatic monocarboxylic acid with 8–18 carbon atoms and X is residual group obtained by removing all hydroxyl groups from (poly)alkyleneglycol having (poly) oxyalkylene group formed with a total of 1–10 oxyethylene units and/or oxypropylene units.

In the above, $R^1$ and $R^3$ are each residual group obtained by removing hydrogen atom from aliphatic monohydric alcohol with 8–18 carbon atoms such as octyl alcohol, lauryl alcohol, tridecyl alcohol, myristyl alcohol, cetyl alcohol, stearyl alcohol and oleyl alcohol. $R^2$ is residual group obtained by removing hydrogen atom from aliphatic monocarboxylic acid with 8–18 carbon atoms such as caproic acid, caprylic acid, caprynic acid, undecanoic acid, laurinic acid, tridecanoic acid, myristic acid, pentadecanoic acid, palmitic acid, stearic acid, palmitoleic acid, oleic acid, isooctanoic acid, hexadecanoic acid and isooctadecanoic acid. X is residual group obtained by removing all hydroxyl groups from (poly)alkyleneglycol having (poly)oxyalkylene group formed with a total of 1–10 oxyethylene units and/or oxypropylene units. Examples of such residual group include (1) residual groups obtained by removing all hydroxyl groups from (poly)ethyleneglycol having (poly) oxyethylene group formed with a total of 1–10 oxyethylene units; (2) residual groups obtained by removing all hydroxyl groups from (poly)propyleneglycol having (poly)oxypropylene group formed with a total of 1–10 oxypropylene units; and (3) residual groups obtained by removing all hydroxyl groups from (poly)alkyleneglycol having (poly)oxyethylene (poly)oxypropylene group formed with a total of 2–10 oxyethylene units and oxypropylene units. $R^4$ is residual group obtained by removing hydroxyl group from aliphatic monocarboxylic acid with 8–18 carbon atoms such as caproic acid, caprylic acid, caprynic acid, undecanoic acid, laurinic acid, tridecanoic acid, myristic acid, pentadecanoic acid, palmitic acid, stearic acid, palmitoleic acid, oleic acid, isooctanoic acid, hexadecanoic acid and isooctadecanoic acid.

Although an extensive description has been presented above concerting Component D, those containing a nonionic surfactant as emulsifier by 20 weight % or more, those containing an anionic surfactant as antistatic agent by 1–20 weight % and aliphatic ester compounds shown by Formula (1) and/or aliphatic ester compounds shown by Formula (2) as lubricant coadjuvant by a total of 25–60 weight % are preferred. In particular, those comprised of the three components of an emulsifier, an antistatic agent and a lubricant coadjuvant, containing a nonionic surfactant as emulsifier by 50–70 weight %, an anionic surfactant as antistatic agent by 1–10 weight % and aliphatic ester compounds shown by Formula (1) and/or aliphatic ester compounds shown by Formula (2) as lubricant coadjuvant by a total of 25–40 weight % are preferable as Component D.

As explained above, processing agents according to this invention are characterized not only as being comprised of four components, that is, Components A, B, C and D but also as containing these four components by a total of 70 weight % or more and containing 55–92 weight parts of Component A, 0.3–5 weight parts of Component B, 0.1–3 weight parts of Component C and 0.6–44 weight parts of Component D for 100 weights of the total of these four components. More preferably, however, processing agents according to this invention are characterized as containing these four components by a total of 80 weight % or more and containing 55–90 weight parts of Component A, 0.5–2 weight parts of Component B, 0.5–2 weight parts of Component C and 9–41 weight parts of Component D for 100 weights of the total of these four components.

Processing agents according to this invention may contain other components within the limitation of not adversely affecting the desired effects obtained by the invention. Examples of such other components that may be contained include emulsion coadjutants, antifoaming agents, stabilizers, antiseptics and antirust agents.

Next, the method according to this invention for processing synthetic fibers (hereinafter referred to simply as the method of this invention) is explained. The method of this invention is a method of applying a processing agent of this invention as described above at a rate of 0.1–3 weight % and more preferably 0.3–1.2 weight % of the synthetic fibers to be processed. The fabrication step during which a processing agent of this invention is to be applied to the synthetic fibers may be the spinning step or the step during which spinning and drawing are carried out simultaneously. Examples of the method of causing a processing agent of this invention to be attached to the synthetic fibers include the roller oiling method, the guide oiling method using a measuring pump, the emersion oiling method and the spray oiling method. The form in which a processing agent of this invention may be applied to synthetic fibers may be as a neat, as an organic solution or as an aqueous solution but the form as an aqueous solution is preferable, and it is particularly preferable as an aqueous solution of 5–30 weight %. When such a solution is applied, it is preferable to apply the solution at a rate of 0.1–3 weight % and more particular 0.3–1.2 weight % as the processing agent with respect to the synthetic fiber.

Examples of synthetic fibers that may be processed by a method of this invention include (1) polyester fibers such as polyethylene terephthalate, polypropylene terephthalate and polylactic ester fibers; (2) polyamide fibers such as nylon 6 and nylon 66; (3) polyacryl fibers such as polyacrylic and modacrylic fibers; (4) polyolefin fibers such as polyethylene and polypropylene fibers and polyurethane fibers. The present invention is particularly effective, however, when applied to polyester fibers and polyamide fibers.

The invention is described next by way of embodiments. Processing agents according to this invention may be described by way of the following six (1–6) embodiments of the invention:

Embodiment 1

Processing agent for synthetic fibers containing Components A, B, C and D as described below respectively by 65 weight %, 1.5 weight %, 1 weight % and 32.5 weight % (for a total of 100 weight %) wherein:

Component A is a mixture of alkyleneoxide addition compound (A-1) and alkyleneoxide addition compound (A-6) at weight ratio of 45/20 where alkyleneoxide addition compound (A-1) has number average molecular weight of 3500, having random addition of EO (ethylene oxide) and PO (propylene oxide) to dodecyl alcohol at weight ratio of 70/30, and alkyleneoxide addition compound (A-6) has number average molecular weight of 1000, having random addition of EO and PO to hexadecyl alcohol at weight ratio of 50/50;

Component B is polyoxyalkylene-modified silicone (B-1) having polyoxyalkylene group with oxyalkylene units including both oxyethylene units and oxypropylene units and silicone chain at weight ratio of 70/30(50% of the oxyalkylene units being oxyethylene units);

Component C is 2,2'-methylene-bis-(4-methyl-6-t-butylphenol) (hereinafter referred to as phenol antioxidant (C-1)); and Component D is a mixture of Emulsifier (D-1), Emulsifier (D-2), Emulsifier (D-3), antistatic agent (D-7), antistatic agent (D-9) and Lubricant coadjuvant (D-11) at weight ratio of 10/10/1/0.5/1/10 where Emulsifier (D-1) is ω-hydroxy (polyoxyethylene) (repetition number n of oxyethylene units =7) octadecenate, Emulsifier (D-2) is α-dodecyl-ω-hydroxy (polyoxypropylene polyoxyethylene) (repetition number m of oxypropylene units 3, n=4), Emulsifier (D-3) is ethylene oxide adduct (n=20) of hydrogenated castor oil, antistatic agent (D-7) is potassium decanesulfonate, and antistatic agent (D-9) is potassium phosphoric acid ester of α-dodecyl-ω-hydroxy (polyoxyethylene) (n=3) and Lubricant coadjuvant (D-11) is dodecyl octanoate.

Embodiment 2

Processing agent for synthetic fibers containing Components A, B, C and D as described below respectively by 65 weight %, 1.5 weight %, 1 weight % and 32.5 weight % (for a total of 100 weight %) wherein:

Component A is a mixture of aforementioned alkyleneoxide addition compound (A-1) and aforementioned alkyleneoxide addition compound (A-6) at weight ratio of 45/20;

Component B is aforementioned polyoxyalkylene-modified silicone (B-1);

Component C is aforementioned phenol antioxidant (C-1); and

Component D is a mixture of aforementioned Emulsifier (D-1), aforementioned Emulsifier (D-2), aforementioned Emulsifier (D-3), aforementioned antistatic agent (D-7), aforementioned antistatic agent (D-9) and Lubricant coadjuvant (D-12) at weight ratio of 10/10/1/0.5/1/10 where Lubricant coadjuvant (D-12) is ester of α-dodecyl-ω-hydroxy (polyoxyethylene) (n=6) and decanoic acid.

Embodiment 3

Processing agent for synthetic fibers containing Components A, B, C and D as described below respectively by 70 weight %, 1.5 weight %, 1 weight % and 27.5 weight % (for a total of 100 weight %) wherein:

Component A is a mixture of aforementioned alkyleneoxide addition compound (A-1) and aforementioned alkyleneoxide addition compound (A-6) at weight ratio of 50/20;

Component B is aforementioned polyoxyalkylene-modified silicone (B-1);

Component C is aforementioned phenol antioxidant (C-1); and

Component D is a mixture of aforementioned Emulsifier (D-1), aforementioned Emulsifier (D-2), aforementioned Emulsifier (D-3), aforementioned antistatic agent (D-7), aforementioned antistatic agent (D-9) and aforementioned Lubricant coadjuvant (D-11) at weight ratio of 10/10/3/0.5/1/3.

Embodiment 4

Processing agent for synthetic fibers containing Components A, B, C and D as described below respectively by 65 weight %, 1.5 weight %, 1 weight % and 32.5 weight % (for a total of 100 weight %) wherein:

Component A is a mixture of aforementioned alkyleneoxide addition compound (A-1) and aforementioned alkyleneoxide addition compound (A-6) at weight ratio of 45/20;

Component B is aforementioned polyoxyalkylene-modified silicone (B-1);

Component C is aforementioned phenol antioxidant (C-1); and

Component D is a mixture of aforementioned Emulsifier (D-1), aforementioned Emulsifier (D-2), aforementioned Emulsifier (D-3), aforementioned antistatic agent (D-7), aforementioned antistatic agent (D-9) and Lubricant coadjuvant (D-13) at weight ratio of 10/10/1/0.5/1/10 wherein Lubricant coadjuvant (D-13) is dodecyl dodecanate.

Embodiment 5

Processing agent for synthetic fibers containing Components A, B, C and D as described below respectively by 65 weight %, 1.5 weight %, 1 weight % and 32.5 weight % (for a total of 100 weight %) wherein:

Component A is a mixture of aforementioned alkyleneoxide addition compound (A-1) and aforementioned alkyleneoxide addition compound (A-6) at weight ratio of 45/20;

Component B is aforementioned polyoxyalkylene-modified silicone (B-1);

Component C is aforementioned phenol antioxidant (C-1); and

Component D is a mixture of aforementioned Emulsifier (D-1), aforementioned Emulsifier (D-2), aforementioned Emulsifier (D-3), aforementioned antistatic agent (D-7), aforementioned antistatic agent (D-9) and Lubricant coadjuvant (D-14) at weight ratio of 10/10/1/0.5/1/10 wherein Lubricant coadjuvant (D-14) is 2-ethylhexyl octadecenate.

Embodiment 6

Processing agent for synthetic fibers containing Components A, B, C and D as described below respectively by 70 weight %, 1.5 weight %, 1 weight % and 27.5 weight % (for a total of 100 weight %) wherein:

Component A is a mixture of aforementioned alkyleneoxide addition compound (A-1) and aforementioned alkyleneoxide addition compound (A-6) at weight ratio of 50/20;

Component B is aforementioned polyoxyalkylene-modified silicone (B-1);

Component C is aforementioned phenol antioxidant (C-1); and

Component D is a mixture of aforementioned Emulsifier (D-1), aforementioned Emulsifier (D-2), aforementioned Emulsifier (D-3), aforementioned antistatic agent (D-7), aforementioned antistatic agent (D-9) and aforementioned Lubricant coadjuvant (D-13) at weight ratio of 10/10/3/0.5/1/3.

A processing method according to this invention may be described by way of the following embodiment of the invention:

Embodiment 7

Method of processing synthetic fibers by preparing an aqueous solution containing a processing agent of any of Embodiments 1–6 described above by 10 weight % and applying this aqueous solution to polyethylene terephthalate fibers that have been spun at a rate of 0.5 weight % as processing agent.

The invention will be described next by way of examples in order to make its details and effects clearer but it goes without saying that these examples are not intended to limit the scope of the invention. In what follows, "parts" will mean "weight parts" and "%" will mean "weight %" unless otherwise specified.

Part 1 (Preparation of Processing Agents for Synthetic Fibers)

Test Example 1 (Preparation of Processing Agent (P-1))

Processing agent (P-1) was prepared by uniformly mixing together 65 parts of Component A, 1.5 parts of Component B, 1 part of Component C and 32.5 parts of Component D where Component A is a mixture of alkyleneoxide addition compound with number average molecular weight of 3500 with random addition of EO and PO at weight ratio of 70/30 to dodecyl alcohol and alkyleneoxide addition compound with number average molecular weight of 1000 with random addition of EO and PO at weight ratio of 50/50 to hexadecyl alcohol at a weight ratio of 45/20; Component B is polyoxyalkylene-modified silicone (B-1) having polyoxyalkylene group with oxyalkylene units including both oxyethylene units and oxypropylene units and silicone chain at weight ratio of 70/30 (50% of the oxyalkylene units being oxyethylene units); Component C is 2,2'-methylene-bis-(4-methyl-6-t-butylphenol); and Component D is a mixture of ω-hydroxy (polyoxyethylene) (n=7) octadecenate, α-dodecyl-ω-hydroxy (polyoxypropylene polyoxyethylene) (m=3, n=4), ethylene oxide adduct (n=20) of hydrogenated castor oil, potassium decanesulfonate, potassium phosphoric acid ester of α-dodecyl-ω-hydroxy (polyoxyethylene) (n=3) and dodecyl octanoate (Formula (2) where $R^3$ is residual group obtained by removing hydrogen atom from dodecyl alcohol and $R^4$ is residual group obtained by removing hydroxyl group from octanoic acid) at weight ratio of 10/10/1/0.6/1/10.

Test Examples 2–6 and Comparison Examples 1–19 (Preparation of Processing Agents (P-2)-(P-37) and (R-1)-(R-19))

Processing agents (P-2)–(P-6) of Test Examples 2–6 and processing agents (R-1)–(R-19) of Comparison Examples 1–19 were prepared similarly as processing agent (P-1) of Test Example 1. Details of the components used for the preparation of these processing agents are shown in Tables 1–4 and the details of these processing agents are shown in Tables 5–7.

TABLE 1

| | Aliphatic alcohol used for synthesis | | | | Alkyleneoxide addition compound | | | | |
|---|---|---|---|---|---|---|---|---|---|
| | Kind | *1 | *2 | Form | *3 | *4 | *5 | *6 | NAMW |
| A-1 | Dodecyl alcohol | 1 | 12 | Straight-chain | EO/PO | R | 70 | —OH | 3500 |
| A-2 | Octyl alcohol | 1 | 8 | Straight-chain | EO/PO | R | 40 | —OH | 1000 |
| A-3 | Butyl alcohol | 1 | 4 | Straight-chain | EO/PO | R | 50 | —OH | 3000 |
| A-4 | Dodecyl alcohol | 1 | 12 | Straight-chain | EO/PO | R | 25 | —OH | 1000 |
| A-5 | Dodecyl alcohol | 1 | 12 | Straight-chain | EO.PO | R | 90 | —OH | 2500 |
| A-6 | Hexadecyl alcohol | 1 | 16 | Straight-chain | EO/PO | R | 50 | —OH | 1000 |
| A-7 | Tetradecyl alcohol | 1 | 14 | Straight-chain | EO/PO | B | 55 | —OH | 2500 |

TABLE 1-continued

| | Aliphatic alcohol used for synthesis | | | | Alkyleneoxide addition compound | | | | |
|---|---|---|---|---|---|---|---|---|---|
| | Kind | *1 | *2 | Form | *3 | *4 | *5 | *6 | NAMW |
| A-8 | Isohexadecyl alcohol | 1 | 16 | Branched-chain | EO/PO | R | 50 | —OH | 1000 |
| A-9 | Hexadecyl alcohol | 1 | 16 | Straight-chain | EO/PO | R | 25 | —OH | 2500 |
| A-10 | Hexadecyl alcohol | 1 | 16 | Straight-chain | EO/PO | R | 90 | —OH | 2500 |
| A-11 | Octadecyl alcohol | 1 | 18 | Straight-chain | EO/PO | R | 45 | —OCH3 | 2000 |
| A-12 | Trimethylol propane | 3 | 6 | Branched-chain | EO/PO | R | 10 | —OH | 6000 |
| A-13 | Trimethylol propane | 3 | 6 | Branched-chain | EO/PO | R | 40 | —OH | 6000 |
| A-14 | Glycerol | 3 | 3 | Branched-chain | EO/PO | R | 60 | —OH | 6000 |
| A-15 | Propylene glycol | 2 | 3 | Branched-chain | EO/PO | B | 25 | —OH | 2000 |

In Table 1 (and thereafter):
*1: Valence
*2: Number of carbon atoms
*3: Form
*4: Kind of alkyleneoxide
*5: Ratio (%) of oxyethylene units in polyoxyalkylene group
*6: End group of polyoxyalkylene group
NAMW: Number average molecular weight

TABLE 2

| | *7 | *8 | NAMW |
|---|---|---|---|
| B-1 | 70/30 | 50 | 16000 |
| B-2 | 35/65 | 20 | 11000 |
| B-3 | 94/6 | 50 | 43000 |

In Table 2:
*7: Weight ratio between polyoxyalkylene group with oxyalkylene units including oxyethylene units and oxypropylene units/silicone chains
*8: Ratio (%) of oxyethylene units in oxyalkylene units

TABLE 3

| | Name of compound | Type |
|---|---|---|
| C-1 | 2,2'-methylene-bis-(4-methyl-6-t-butylphenol) | phenol antioxidant |
| C-2 | 1,3,5-tris(4-butyl-3-hydroxy-2,6-dimethylbenzyl) isocyanuric acid | phenol antioxidant |
| C-3 | octyldiphenyl phosphite | phosphite antioxidant |
| C-4 | dilauryl-3,3'-thiodipropionate | thioether antioxidant |

TABLE 4

| | Type | Kind | Compound |
|---|---|---|---|
| D-1 | EM | NS | ω-hydroxy (polyoxyethylene) (n = 7) octadecenate |
| D-2 | EM | NS | α-dodecyl-ω-hydroxy (polyoxypropylene polyoxyethylene) (m = 3, n = 4) |
| D-3 | EM | NS | ethylene oxide adduct (n = 20) of hydrogenated castor oil |
| D-4 | EM | NS | sorbitan monolaurate |
| D-5 | EM | NS | amide of diethanolamine and decanoic acid |
| D-6 | EM | CS | trimethyloctyl ammonium octyl phosphate |
| D-7 | AO | AS | potassium decane sulfonate |
| D-8 | AO | AS | potassium cis-9-octadecenate |
| D-9 | AO | AS | potassium dodecylpoly (oxyethylene)(n = 3) phosphate |

TABLE 4-continued

| | Type | Kind | Compound |
|---|---|---|---|
| D-10 | AO | AS | potassium tetracosyl phosphate |
| D-11 | LC | AEC | dodecyl octanoate (Formula (2) where $R^3$ is residual group obtained by removing hydrogen atom from dodecyl alcohol and $R^4$ is residual group obtained by removing hydroxyl group from octanoic acid) |
| D-12 | LC | AEC | ester of α-dodecyl-ω-hydroxy (polyoxyethylene) (n = 6) and decanoic acid (Formula (1) where $R^1$ is residual group obtained by removing hydrogen atom from dodecyl alcohol, $R^2$ is residual group obtained by removing hydroxyl group from decanoic acid and X is residual group obtained by removing all hydroxyl groups from polyethylene glycol having polyoxyethylene group with 6 oxyethylene units) |
| D-13 | LC | AEC | dodecyl dodecanate |
| D-14 | LC | AEC | 2-ethylhexyl octadecenate |
| D-15 | LC | MO | mineral oil with viscosity $3 \times 10^{-2}$ $m^2/s$ at 30° C. |

In Table 4:
EM: Emulsifier;
AO: Antistatic agent;
LC: Lubricant coadjuvant;
NS: Nonionic surfactant;
CS: Cationic surfactant;
AS: Anionic surfactant;
AEC: Aliphatic ester compound;
MO: Mineral oil.

TABLE 5

| | Test Example | | | | | |
|---|---|---|---|---|---|---|
| | 1 P-1 | 2 P-2 | 3 P-3 | 4 P-4 | 5 P-5 | 6 P-6 |
| A-1 | 45 | 45 | 50 | 45 | 45 | 50 |
| A-2 | | | | | | |
| A-3 | | | | | | |
| A-4 | | | | | | |
| A-5 | | | | | | |
| A-6 | 20 | 20 | 20 | 20 | 20 | 20 |
| A-7 | | | | | | |

TABLE 5-continued

| | Test Example | | | | | |
|---|---|---|---|---|---|---|
| | 1 P-1 | 2 P-2 | 3 P-3 | 4 P-4 | 5 P-5 | 6 P-6 |
| A-8 | | | | | | |
| A-9 | | | | | | |
| A-10 | | | | | | |
| A-11 | | | | | | |
| A-12 | | | | | | |
| A-13 | | | | | | |
| A-14 | | | | | | |
| A-15 | | | | | | |
| B-1 | 1.5 | 1.5 | 1.5 | 1.5 | 1.5 | 1.5 |
| B-2 | | | | | | |
| B-3 | | | | | | |
| C-1 | 1 | 1 | 1 | 1 | 1 | |
| C-2 | | | | | | |
| C-3 | | | | | | |
| C-4 | | | | | | |
| D-1 | 10 | 10 | 10 | 10 | 10 | 10 |
| D-2 | 10 | 10 | 10 | 10 | 10 | 10 |
| D-3 | 1 | 1 | 3 | 1 | 1 | 3 |
| D-4 | | | | | | |
| D-5 | | | | | | |
| D-6 | | | | | | |

TABLE 5-continued

| | Test Example | | | | | |
|---|---|---|---|---|---|---|
| | 1 P-1 | 2 P-2 | 3 P-3 | 4 P-4 | 5 P-5 | 6 P-6 |
| D-7 | 0.5 | 0.5 | 0.5 | 0.5 | 0.5 | 0.5 |
| D-8 | | | | | | |
| D-9 | 1 | 1 | 1 | 1 | 1 | 1 |
| D-10 | | | | | | |
| D-11 | 10 | | 3 | | | |
| D-12 | | 10 | | | | |
| D-13 | | | | 10 | | 3 |
| D-14 | | | | | 10 | |
| D-15 | | | | | | |
| G-1 | | | | | | |
| Total | 100 | 100 | 100 | 100 | 100 | 100 |
| A/(A − D) | 65 | 65 | 70 | 65 | 65 | 70 |
| B/(A − D) | 1.5 | 1.5 | 1.5 | 1.5 | 1.5 | 1.5 |
| C/(A − D) | 1 | 1 | 1 | 1 | 1 | 1 |
| D/(A − D) | 32.5 | 32.5 | 27.5 | 32.5 | 32.5 | 27.5 |
| A3/A | 100 | 100 | 100 | 100 | 100 | 100 |
| (E + F)/A | 100 | 100 | 100 | 100 | 100 | 100 |
| E/F | 69.2/ 30.8 | 69.2/ 30.8 | 71.4/ 28.6 | 69.2/ 30.8 | 69.2/ 30.8 | 71.4/ 28.6 |
| $D^1/D$ | 64.6 | 64.6 | 83.6 | 64.6 | 64.6 | 83.6 |
| $D^2/D$ | 4.6 | 4.6 | 5.5 | 4.6 | 4.6 | 5.5 |
| $D^3/D$ | 30.8 | 30.8 | 10.9 | 30.8 | 30.8 | 10.9 |

TABLE 6

| | Comparison Example | | | | | | | | | |
|---|---|---|---|---|---|---|---|---|---|---|
| | 1 R-1 | 2 R-2 | 3 R-3 | 4 R-4 | 5 R-5 | 6 R-6 | 7 R-7 | 8 R-8 | 9 R-9 | 10 R-10 |
| A-1 | 30 | 60 | | 20 | | | | 50 | 40 | 20 |
| A-2 | | | | | | | | | 55 | |
| A-3 | | | 50 | | | | | | | |
| A-4 | | | | | 50 | | | | | |
| A-5 | | | | | | 50 | | | | |
| A-6 | 15 | 35 | 20 | | 20 | 20 | | 20 | | |
| A-7 | | | | | | | | | | |
| A-8 | | | | | | | | | | |
| A-9 | | | | | | | | | | |
| A-10 | | | | | | | | | | |
| A-11 | | | | | | | | | | |
| A-12 | | | | | | | | | | |
| A-13 | | | | | | | | | | |
| A-14 | | | | 50 | | | 75 | | | 56 |
| A-15 | | | | | | | | | | |
| B-1 | 1.5 | 1 | 1.5 | 1.5 | 1.5 | 1.5 | 1 | | | |
| B-2 | | | | | | | | | | |
| B-3 | | | | | | | | | | |
| C-1 | 1 | 1 | 1 | 1 | 1 | 1 | | 1 | 1 | |
| C-2 | | | | | | | 0.5 | | | |
| C-3 | | | | | | | | | | |
| C-4 | | | | | | | | | | |
| D-1 | 20 | 2 | 10 | 10 | 10 | 10 | 2 | 10 | | |
| D-2 | 21 | | 10 | 10 | 10 | 10 | 10 | 11.5 | | |
| D-3 | 10 | | 6 | 6 | 6 | 6 | | 6 | | |

TABLE 6-continued

| | Comparison Example | | | | | | | | | |
|---|---|---|---|---|---|---|---|---|---|---|
| | 1<br>R-1 | 2<br>R-2 | 3<br>R-3 | 4<br>R-4 | 5<br>R-5 | 6<br>R-6 | 7<br>R-7 | 8<br>R-8 | 9<br>R-9 | 10<br>R-10 |
| D-4 | | | | | | | | | | |
| D-5 | | | | | | | | | | |
| D-6 | | | | | | | | | | |
| D-7 | 0.5 | | 0.5 | 0.5 | 0.5 | 0.5 | 1 | 0.5 | | |
| D-8 | | | | | | | | | | 1 |
| D-9 | 1 | 1 | 1 | 1 | 1 | 1 | 0.5 | 1 | 4 | |
| D-10 | | | | | | | | | | 3 |
| D-11 | | | | | | | | | | 20 |
| D-12 | | | | | | | 10 | | | |
| D-13 | | | | | | | | | | |
| D-14 | | | | | | | | | | |
| D-15 | | | | | | | | | | |
| G-1 | | | | | | | | | | |
| Total | 100 | 100 | 100 | 100 | 100 | 100 | 100 | 100 | 100 | 100 |
| A/(A − D) | 45 | 95 | 70 | 70 | 70 | 70 | 75 | 70 | 95 | 76 |
| B/(A − D) | 1.5 | 1 | 1.5 | 1.5 | 1.5 | 1.5 | 1 | 0 | 0 | 0 |
| C/(A − D) | 1 | 1 | 1 | 1 | 1 | 1 | 0.5 | 1 | 1 | 0 |
| D/(A − D) | 52.5 | 3 | 27.5 | 27.5 | 27.5 | 27.5 | 23.5 | 29 | 4 | 24 |
| A3/A | 100 | 100 | 28.6 | 28.6 | 28.6 | 28.6 | 0 | 100 | 100 | 26.3 |
| (E + F)/A | 100 | 100 | 100 | 28.6 | 28.6 | 28.6 | 0 | 100 | 100 | 26.3 |
| E/F | 66.7/33.3 | 63.2/36.8 | 71.4/28.6 | 100/0 | 0/100 | 0/100 | 0/0 | 71.4/28.6 | 100/0 | 100/0 |
| $D^1/D$ | 97.1 | 66.7 | 94.5 | 94.5 | 94.5 | 94.5 | 51.1 | 94.8 | 0 | 0 |
| $D^2/D$ | 2.9 | 33.3 | 5.5 | 5.5 | 5.5 | 5.5 | 6.4 | 5.2 | 100 | 16.7 |
| $D^3/D$ | 0 | 0 | 0 | 0 | 0 | 0 | 42.6 | 0 | 0 | 83.3 |

TABLE 7

| | Comparison Example | | | | | | | | |
|---|---|---|---|---|---|---|---|---|---|
| | 11<br>R-11 | 12<br>R-12 | 13<br>R-13 | 14<br>R-14 | 15<br>R-15 | 16<br>R-16 | 17<br>R-17 | 18<br>R-18 | 19<br>R-19 |
| A-1 | | 50 | 50 | 50 | | 50 | 50 | 68 | 30 |
| A-2 | 29 | | | | | | | | |
| A-3 | | | | | 47 | | | | |
| A-4 | | | | | | | | | |
| A-5 | | | | | | | | | |
| A-6 | | 20 | 20 | 20 | | 37 | 20 | 29 | 15 |
| A-7 | 20 | | | | 16 | | | | |
| A-8 | | | | | | | | | |
| A-9 | | | | | | | | | |
| A-10 | | | | | | | | | |
| A-11 | | | | | | | | | |
| A-12 | | | | | | | | | |
| A-13 | | | | | 32 | | | | |
| A-14 | | | | | | | | | |
| A-15 | | | | | | | | | |
| B-1 | 1 | | 6 | 1.5 | 1 | 1.5 | 1.5 | 1.5 | 1.5 |
| B-2 | | | | | | | | | |
| B-3 | | 1.5 | | | | | | | |
| C-1 | | 1 | 1 | | | | 4 | 1.5 | 1 |
| C-2 | | | | | | | | | |
| C-3 | | | | | | | | | |
| C-4 | | | | | | | | | |
| D-1 | | 10 | 10 | 10 | | | 10 | | 20 |
| D-2 | 5 | 10 | 10 | 11 | | 10 | 10 | | 20 |
| D-3 | | 6 | 6 | 6 | | | 3 | | 6 |
| D-4 | | | | | | | | | |
| D-5 | | | | | | | | | |
| D-6 | | | | | | | | | |
| D-7 | | 0.5 | 0.5 | 0.5 | | 0.5 | 0.5 | | 0.5 |
| D-8 | | | | | 2 | 0.5 | | | |
| D-9 | 5 | 1 | 1 | 1 | | 0.5 | 1 | | 1 |
| D-10 | | | | | | | | | |
| D-11 | | | | | | | | | 5 |
| D-12 | 40 | | | | | | | | |
| D-13 | | | | | | | | | |
| D-14 | | | | | | | | | |

TABLE 7-continued

| | Comparison Example | | | | | | | | |
|---|---|---|---|---|---|---|---|---|---|
| | 11 R-11 | 12 R-12 | 13 R-13 | 14 R-14 | 15 R-15 | 16 R-16 | 17 R-17 | 18 R-18 | 19 R-19 |
| D-15 | | | | | | | | | |
| G-1 | | | | | | | | | |
| Total | 100 | 100 | 104.5 | 100 | 100 | 100 | 100 | 100 | 100 |
| A/(A – D) | 49 | 70 | 70 | 70 | 95 | 87 | 70 | 97 | 45 |
| B/(A – D) | 1 | 0 | 6 | 1.5 | 1 | 1.5 | 1.5 | 1.5 | 1.5 |
| C/(A – D) | 0 | 1 | 1 | 0 | 0 | 0 | 4 | 1.5 | 1 |
| D/(A – D) | 50 | 27.5 | 27.5 | 28.5 | 2 | 11.5 | 24.5 | 0 | 52.5 |
| A3/A | 100 | 100 | 100 | 100 | 16.8 | 100 | 100 | 100 | 100 |
| (E + F)/A | 100 | 100 | 100 | 100 | 66.3 | 100 | 100 | 100 | 100 |
| E/F | 59.2/40.8 | 71.4/28.6 | 71.4/2 8.6 | 71.4/28.6 | 25.3/74.7 | 57.5/42.5 | 71.4 28.6 | 70.1/29.9 | 66.7/3 3.3 |
| $D^1/D$ | 10 | 94.5 | 94.5 | 94.7 | 0 | 87 | 93.9 | 0 | 87.6 |
| $D^2/D$ | 10 | 5.5 | 5.5 | 5.3 | 100 | 13 | 6.1 | 0 | 2.9 |
| $D^3/D$ | 80 | 0 | 0 | 0 | 0 | 0 | 0 | 0 | 9.5 |

In Tables 5–7:

A/(A-D): Ratio (part) of Component A to the total of 100 weight parts of Components A, B, C and D;

B/(A-D): Ratio (part) of Component B to the total of 100 weight parts of Components A, B, C and D;

C/(A-D): Ratio (part) of Component C to the total of 100 weight parts of Components A, B, C and D;

D/(A-D): Ratio (part) of Component D to the total of 100 weight parts of Components A, B, C and D;

A3/A: Ratio (%) of alkyleneoxide addition compound with Condition 3 in Component A;

(E+F)/A: Ratio (%) of Components E and F in Component A;

E/F: Weight ratio between Components E and F;

$D^1/D$: Ratio (%) of emulsifier in Component D;

$D^2/D$: Ratio (%) of antistatic agent in Component D;

$D^3/D$: Ratio (%) of lubricant coadjuvant in Component D;

A-1-A-15: Alkyleneoxide addition compounds shown in Table 1;

B-1-B-3: Polyoxyalkylene-modified silicone shown in Table 2;

C-1-C-4: Antioxidants shown in Table 3;

D1-D6: Emulsifiers shown in Table 4;

D7-D-10: Antistatic agents shown in Table 4;

D-11-D-15: Lubricant coadjuvants shown in Table 4;

G-1: Ethylene glycol

Part 2

Attachment of Processing Agent Onto Synthetic Fibers

Each of the processing agents prepared in Part 1 was diluted with water to prepare a 10% aqueous solution. After polyethylene terephthalate chips with intrinsic viscosity of 0.64 and containing titanium oxide by 0.2% were dried by a known method, they were spun at 295° C. by using an extruder. The 10% aqueous solution thus prepared was applied onto the yarns extruded output of the nozzle to be cooled and solidified by a guide oiling method using a measuring pump such that the attached amount of the processing agent became as shown in Tables 6 and 7. Thereafter, the yarns were collected by means of a guide and wound up at the rate of 300 m/minute without any drawing by a mechanical means to obtain partially drawn 128 decitex-36 filament yarns as wound cakes of 10 kg.

False Twisting

The cakes thus obtained as described above were subjected to a false twisting process under the conditions described below by using a false twister of the contact heater type (product name of SDS1200 produced by Teijinseiki Co., Ltd.):

| | |
|---|---|
| Fabrication speeds: | 800 m/minute and 1200 m/minute; |
| Draw ratio: | 1.652; |
| Twisting system: | Three-axis disk friction method (with one guide disk on the inlet side, one guide disk on the outlet side and four hard polyurethane disks); |
| Heater on twisting side: | Length of 2.5 m with surface temperature of 210° C.; |
| Heater on untwisting side; | None; |
| Target number of twisting; | 3300 T/m. |

The false twisting process was carried out under the conditions given above by a continuous operation of 25 days.

Evaluation of Fluffs

In the aforementioned false twisting process, the number of fluffs per hour was measured by means of a fly counter (produce name of DT-105 produced by Toray Engineering Co., Ltd.) before the false twisted yarns were wound up and evaluated according to the standards as described below:

AAA: The measured number of fluffs was zero;

AA: The measured number of fluffs was less than 1 (exclusive of zero);

A: The measured number of fluffs was 1–2;

B: The measured number of fluffs was 3–9;

C: The measured number of fluffs was 10 or greater.

The results of the measurement are shown in Tables 8 and 9.

Evaluation of Yarn Breaking

The number of occurrences of yarn breaking during the 25 days of operation in the false twisting process described above was converted into the number per day and such converted numbers were evaluated according to the standards as described below:

AAA: The number of occurrence was zero;

AA: The number of occurrence was less than 0,5 (exclusive of zero);

A: The number of occurrence was 0.5 or greater and less than 1;

B: The number of occurrence was 1 or greater and less than 5;

C: The number of occurrence was 5 or greater.

The results are shown in Tables 8 and 9.

Dyeing Property

A fabric with diameter of 70 mm and length of 1.2 mm was produced from the false-twisted yarns on which fluffs were measured as above by using a knitting machine for tubular fabric. The fabric thus produced was dyed by a high temperature and high pressure dyeing method by using disperse dyes (product name of Kayalon Polyester Blue-EBL-E produced by Nippon Kayaku Co. Ltd.). The dyed fabrics were washed with water, subjected to a reduction clearing process and dried according to a known routine and were thereafter set on an iron cylinder with diameter 70 mm and length 1 m. An inspection process for visually counting the number of points of densely dyed potion on the fabric surface was repeated five times and the evaluation results thus obtained were converted into the number of points per sheet of fabric. The evaluation was carried out according to the following standards:

AAA: There was no densely dyed portion;

AA: There was 1 point of densely dyed portion;

A: There were 2 points of densely dyed portion;

B: There were 3–6 points of densely dyed portion;

C: There were 7 or more points of densely dyed portion.

The results are shown in Tables 8 and 9.

From the results shown in Tables 8 and 9, it should be clear that the present invention has the favorable effects of sufficiently preventing the occurrence of fluffs, yard breaking and uneven dyeing as the speed of the spinning and fabrication processes of synthetic fibers is increased in recent years.

TABLE 8

| | | | Speed of false twisting process | | | | | |
|---|---|---|---|---|---|---|---|---|
| | | | 800 m/minute | | | 1200 m/minute | | |
| Test Example | Kind | Attached amount | Fluffs | Yarn breaking | Dyeing property | Fluffs | Yarn breaking | Dyeing property |
| 7 | P-1 | 0.6 | AAA | AAA | AAA | AAA | AAA | AAA |
| 8 | P-2 | 0.4 | AAA | AAA | AAA | AAA | AAA | AAA |
| 9 | P-3 | 0.4 | AAA | AAA | AAA | AAA | AAA | AAA |
| 10 | P-4 | 0.6 | AAA | AAA | AAA | AAA | AAA | AAA |
| 11 | P-5 | 0.4 | AAA | AAA | AAA | AAA | AAA | AAA |
| 12 | P-6 | 0.4 | AAA | AAA | AAA | AAA | AAA | AAA |

TABLE 9

| | | | Speed of false twisting process | | | | | |
|---|---|---|---|---|---|---|---|---|
| | | | 800 m/minute | | | 1200 m/minute | | |
| Comparison Example | Kind | Attached amount | Fluffs | Yarn breaking | Dyeing property | Fluffs | Yarn breaking | Dyeing property |
| 20 | R-1 | 0.4 | B | C | C | C | C | C |
| 21 | R-2 | 0.4 | B | A | C | C | B | C |
| 22 | R-3 | 0.4 | B | B | B | C | B | C |
| 23 | R-4 | 0.4 | B | B | B | C | B | C |
| 24 | R-5 | 0.4 | C | A | C | C | B | B |
| 25 | R-6 | 0.4 | B | B | B | C | C | B |
| 26 | R-7 | 0.4 | B | A | B | C | B | B |
| 27 | R-8 | 0.4 | B | B | C | C | C | C |
| 28 | R-9 | 0.4 | C | B | C | C | C | C |
| 29 | R-10 | 0.4 | C | C | C | C | C | C |
| 30 | R-11 | 0.6 | C | C | C | C | C | C |
| 31 | R-12 | 0.4 | B | B | B | C | C | C |
| 32 | R-13 | 0.5 | B | B | C | C | C | C |
| 33 | R-14 | 0.4 | B | B | B | C | B | C |
| 34 | R-15 | 0.4 | C | B | C | C | C | C |
| 35 | R-16 | 0.4 | C | B | C | C | C | C |
| 36 | R-17 | 0.4 | B | B | B | C | C | C |
| 37 | R-18 | 0.5 | B | A | C | C | B | C |
| 38 | R-19 | 0.6 | B | C | C | C | C | C |

In Tables 8 and 9:

Attached amount: Amount (%) that attached to synthetic fibers as processing agent.

What is claimed is:

1. A processing agent for synthetic fibers, said processing agent containing Component A, Component B, Component C and Component D, said processing agent containing 55–90 weight parts of said Component A, 0.5–2 weight parts of said Component B, 0.5–2 weight parts of said Component C and 9–41 weight parts of said Component D for 100 weight parts of the total of said Components A, B, C and D;

wherein said Component A is one or more alkyleneoxide addition compounds simultaneously satisfying Conditions 1, 2 and 3, said Condition 1 being the condition of having a number average molecular weight of 1000–12000 and being obtainable by adding alkylene oxide with 2–4 carbon atoms to monohydric-trohydric aliphatic alcohol with 1–24 carbon atoms, said Condition 2 being the condition of having polyoxyalkylene groups comprising oxyalkylene units of which 10–80 weight % are oxyethylene units, and said Condition 3 being the condition of containing 30 weight % or more of alkyleneoxide addition compounds obtainable by adding ethylene oxide and propylene oxide to monohydric aliphatic alcohol with 6–24 carbon atoms at weight ratio of 35/65–80/20;

wherein said Component A contains Component E and Component F by a total of 60 weight % or more and at a weight ratio of 40/60–80/20;

wherein said Component E is alkyleneoxide addition compound with number average molecular weight of 1000–12000 and is obtainable by adding ethylene oxide and propylene oxide to monohydric aliphatic alcohol with 6–13 carbon atoms at a weight ratio of 35/65–80/20;

wherein said Component F is alkyleneoxide addition compound with number average molecular weight of 1000–4000 and is obtainable by adding ethylene oxide and propylene oxide to monohydric aliphatic alcohol with 14–16 carbon atoms containing straight-chain aliphatic alcohol by 70 molar % or more at a weight ratio of 35/65–80/20.

wherein said Component B is polyoxyalkylene-modified silicone having polyoxyalkylene groups comprising oxyalkylene units which are oxyethylene units and/or oxypropylene units and containing polyoxyalkylene groups and silicone chains at weight ratio of 25/75–90/10;

wherein said Component C is phenol antioxidants; and wherein said Component D includes nonionic surfactant as emulsifier by 20 weight % or more, anionic surfactant as antistatic agent by 1–20 weight %, and aliphatic ester compound shown by formula $R^1$—X—$R^2$ and/or aliphatic ester compound shown by formula $R^3$–$R^4$ as lubricant coadjuvant by a total amount of 25–60 weight %, where $R^1$ and $R^3$ are each residual group obtained by removing hydrogen atom from aliphatic monohydric alcohol with 8–18 carbon atoms, $R^2$ is residual group obtained by removing hydrogen atom from aliphatic monocarboxylic acid with 8–18 carbon atoms, $R^4$ is residual group obtained by removing hydroxyl group from aliphatic monocarboxylic acid with 8–18 carbon atoms and X is residual group obtained by removing all hydroxyl groups from (poly)alkyleneglycol having (poly)oxyalkylene group formed with a total of 1–10 oxyethylene units and/or oxypropylene units.

2. The processing agent of claim 1 wherein 25 weight % or more of the oxyalkylene units of which said Component B is comprised are oxyethylene units.

3. The processing agent of claim 1 wherein said Component D includes nonionic surfactant as emulsifier by 50–70 weight %, anionic surfactant as antistatic agent by 1–10 weight % and aliphatic ester compound shown by formula $R^1$—X—$R^2$ and/or aliphatic ester compound shown by formula $R^3$–$R^4$ as lubricant coadjuvant by a total amount of 25–40 weight %.

4. A method of processing synthetic fibers, said method comprising the step of applying the processing agent of claim 1 at a rate of 0.1–3 weight % of said synthetic fibers.

5. The method of claim 4 wherein the processing agent comprises 25 weight % or more of the oxyalkylene units of which said Component B is comprised are oxyethylene units.

6. The method of claim 4 wherein Component D includes nonionic surfactant as emulsifier by 50–70 weight %, anionic surfactant as antistatic agent by 1–10 weight % and aliphatic ester compound shown by formula $R^1$—X—$R^2$ and/or aliphatic ester compound shown by formula $R^3$—$R^4$ as lubricant coadjuvant by a total amount of 25–40 weight %.

7. The method of claim 4 further comprising the step of preparing an aqueous solution containing said processing agent by 5–30 weight %, wherein said processing agent is applied as said aqueous solution to said synthetic fibers.

8. The method of claim 7 wherein the processing agent comprises 25 weight % or more of the oxyalkylene units of which said Component B is comprised are oxyethylene units.

9. The method of claim 7 wherein Component D includes nonionic surfactant as emulsifier by 50–70 weight %, anionic surfactant as antistatic agent by 1–10 weight % and aliphatic ester compound shown by formula $R^1$—X—$R^2$ and/or aliphatic ester compound shown by formula $R^3$—$R^4$ as lubricant coadjuvant by a total amount of 25–40 weight %.

* * * * *